US007699026B2

(12) United States Patent
Gordon et al.

(10) Patent No.: US 7,699,026 B2
(45) Date of Patent: Apr. 20, 2010

(54) INSULATION KIT FOR USE WITH A WATER HEATER

(75) Inventors: Michael W. Gordon, East Grands Rapids, MI (US); Ryan C. Ritsema, Middleville, MI (US)

(73) Assignee: Bradford White Corporation, Ambler, PA (US)

( * ) Notice: Subject to any disclaimer, the term of this patent is extended or adjusted under 35 U.S.C. 154(b) by 7 days.

(21) Appl. No.: 11/028,766

(22) Filed: Jan. 4, 2005

(65) Prior Publication Data

US 2006/0144346 A1 Jul. 6, 2006

(51) Int. Cl.
*F24H 9/02* (2006.01)

(52) U.S. Cl. ..... 122/19.2; 122/494; 220/694.1; 206/320

(58) Field of Classification Search ..... 122/19.2, 122/494; 220/567.3, 495.01, 694.1; 206/320; 174/93

See application file for complete search history.

(56) References Cited

U.S. PATENT DOCUMENTS

| | | | | | |
|---|---|---|---|---|---|
| 1,609,858 | A | * | 12/1926 | Bohon | 126/361.1 |
| 1,813,995 | A | | 7/1931 | Henshaw | |
| 2,099,740 | A | | 11/1937 | Kieselbach | |
| 2,321,063 | A | * | 6/1943 | Bohnke | 206/320 |
| 2,642,851 | A | | 6/1953 | McFerran | |
| 2,932,438 | A | * | 4/1960 | Smith | 206/320 |
| 3,741,166 | A | * | 6/1973 | Bailey | 122/23 |
| 3,906,129 | A | | 9/1975 | Damois | |
| 4,009,735 | A | | 3/1977 | Pinsky | |
| 4,039,098 | A | * | 8/1977 | Stilts | 220/694.1 |
| 4,054,711 | A | | 10/1977 | Botsolas | |
| 4,112,281 | A | | 9/1978 | Epps | |
| 4,206,575 | A | | 6/1980 | Leonard | |
| 4,438,728 | A | | 3/1984 | Fracaro | |
| 4,744,488 | A | * | 5/1988 | Nelson | 220/567.3 |
| 4,892,771 | A | | 1/1990 | Rowland | |
| 5,020,481 | A | | 6/1991 | Nelson | |
| 5,143,283 | A | * | 9/1992 | Lancaster | 229/199 |
| 5,302,228 | A | | 4/1994 | Holland | |
| 5,348,780 | A | * | 9/1994 | Boggs et al. | 428/42.3 |
| 5,454,492 | A | | 10/1995 | Hunter et al. | |
| 5,677,026 | A | | 10/1997 | Santoli | |
| 5,890,591 | A | * | 4/1999 | Pienta | 206/410 |
| 5,934,337 | A | * | 8/1999 | Fiala et al. | 138/149 |
| 5,954,265 | A | * | 9/1999 | Hall et al. | 236/94 |
| 5,979,371 | A | | 11/1999 | Lewis | |
| 6,019,255 | A | | 2/2000 | Tanury | |
| 6,123,187 | A | | 9/2000 | Bartels | |
| 6,126,002 | A | * | 10/2000 | Brown et al. | 206/320 |
| 6,182,613 | B1 | * | 2/2001 | McCraney | 122/19.2 |
| 6,412,448 | B1 | | 7/2002 | Kingston | |
| 6,457,237 | B1 | | 10/2002 | Matthews et al. | |
| 6,521,077 | B1 | | 2/2003 | McGivern et al. | |
| 6,532,906 | B1 | | 3/2003 | Knoeppel et al. | |
| 6,679,014 | B2 | | 1/2004 | Hughes et al. | |

* cited by examiner

*Primary Examiner*—Gregory A Wilson
(74) *Attorney, Agent, or Firm*—RatnerPrestia

(57) ABSTRACT

An insulation kit for use with a water heater is provided. The kit includes an insulating cover configured to be wrapped about an exterior surface of the water heater. The insulating cover includes a substantially rectangular body with opposed edges configured to overlap or abut one another when the insulating cover is wrapped about the exterior surface of the water heater and at least one downwardly facing flap configured to provide selective access to the water heater. The kit further includes a fastener packaged with the insulating cover and configured for fixing the opposed edges together, thereby securing the insulating cover adjacent the exterior surface of the water heater.

11 Claims, 5 Drawing Sheets

INSULATION KIT FOR USE WITH A WATER HEATER

FIELD OF THE INVENTION

This invention relates to an insulation cover configured for use with a water heater.

BACKGROUND OF THE INVENTION

A water heater typically includes at least one control panel, at least one serviceable component, and safety information and product ratings on its exterior surface. In some circumstances, such a control panel, serviceable component, and/or safety information and product ratings may be covered by surrounding insulation. To gain access to these features, therefore, the user may need to remove the insulation cover. Alternatively, a user may cut holes in an insulation cover in an attempt to gain access to these features. Such practices are time-consuming, imprecise, and may impair the appearance of the product.

Further complicating the difficult access issue is the fact that water heater assemblies are often installed in cramped locations with very little clearance space. It may be difficult, if not impossible, for a user to manipulate a conventional insulation cover to gain access to water heater features.

Accordingly, there remains a need for an insulation cover that is configured to provide insulation yet reduce the inconvenience associated with access to control panels, serviceable components, and/or safety information and product ratings on the exterior surface of a water heater.

SUMMARY OF THE INVENTION

In one exemplary embodiment, this invention provides an insulation kit for use with a water heater. The kit includes an insulating cover configured to be wrapped about an exterior surface of the water heater. The insulating cover includes a substantially rectangular body with opposed edges configured to overlap or abut one another when the insulating cover is wrapped about the exterior surface of the water heater and at least one downwardly facing flap configured to provide selective access to the water heater. The kit further includes a fastener packaged with the insulating cover and configured for fixing the opposed edges together, thereby securing the insulating cover adjacent the exterior surface of the water heater.

In another exemplary embodiment, a water heater assembly is provided. The water heater assembly includes a water heater having at least one control panel and a removable cover positioned over the control panel for selective access to the control panel. The water heater assembly further includes an insulating cover surrounding the water heater. The insulating cover includes a substantially rectangular body with opposed edges overlapping or abutting one another and at least one flap positioned to cover the removable cover and configured to provide selective access to the removable cover, thereby facilitating removal of the removable cover and access to the control panel. The insulating cover further has a surface on which indicia can be printed. A fastener affixes the overlapping or abutting edges of the insulating cover, thereby securing the insulating cover adjacent the water heater.

In yet another exemplary embodiment, an insulating cover configured to be wrapped about an exterior surface of a water heater is provided. The insulating cover includes a substantially rectangular body and opposed edges configured to overlap or abut one another when the insulating cover is wrapped about the exterior surface of the water heater. The insulating cover further includes at least one downwardly facing flap configured to provide selective access to the water heater, and a surface on which indicia can be printed.

In still another exemplary embodiment, a water heater kit is provided. The water heater kit includes a water heater having at least one control panel and a removable cover positioned over the control panel for selective access to the control panel. An insulating cover is packaged with the water heater and configured to surround the water heater. The insulating cover includes a substantially rectangular body with opposed edges configured to overlap or abut one another and at least one downwardly facing flap configured to cover the removable cover and to provide selective access to the removable cover, thereby facilitating removal of the removable cover and access to the control panel. The insulating cover is rolled and packaged within a sleeve prior to being wrapped about the water heater, thereby facilitating packaging of the insulating cover. A fastener is packaged with the water heater and configured to affix the edges of the insulating cover to secure the insulating cover adjacent the water heater.

In another exemplary embodiment, a method of providing a water heater having at least one control panel and a removable cover positioned over the control panel for selective access to the control panel is provided. An insulating cover is packaged with the water heater, the insulating cover having a substantially rectangular body and at least one flap configured to cover the removable cover of the water heater and to provide selective access to the removable cover. The insulating cover is rolled to facilitate packaging of the insulating cover. A fastener is packaged with the water heater, the fastener being configured to affix edges of the insulating cover to secure the insulating cover adjacent the water heater.

DETAILED DESCRIPTION OF THE INVENTION

Figure 1:
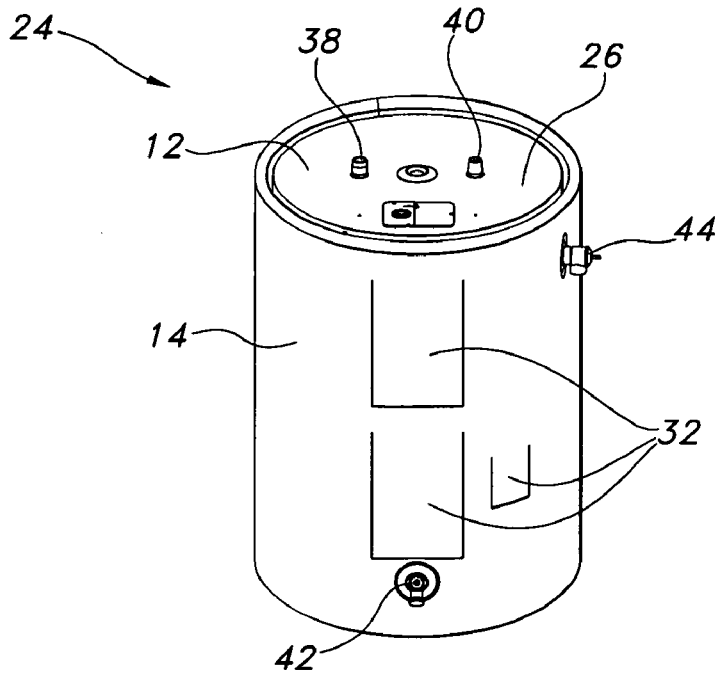
FIG. 1 is a front perspective view of an exemplary embodiment of a water heater assembly showing an embodiment of an insulating cover surrounding and affixed to the water heater, the insulating cover having downwardly facing flaps.

Although the invention is illustrated and described herein with reference to specific embodiments, the invention is not intended to be limited to the details shown. Rather, various modifications may be made in the details within the scope and range of equivalents of the claims and without departing from the invention.

Referring to the figures generally, an exemplary embodiment of an insulation kit 10 for use with a water heater 12 is provided. The kit 10 includes an insulating cover 14 configured to be wrapped about an exterior surface 16 of the water heater 12. The insulating cover 14 includes a substantially rectangular body 18 with opposed edges 20A, 20B configured to overlap or abut one another when the insulating cover 14 is wrapped about the exterior surface 16 of the water heater 12 and at least one downwardly facing flap 32 configured to provide selective access to the water heater 12. The kit 10 further includes a fastener 22A packaged with the insulating cover 14 and configured for fixing the opposed edges 20A, 20B together, thereby securing the insulating cover 14 adjacent the exterior surface 16 of the water heater 12.

In another exemplary embodiment, a water heater assembly 24 is provided. The water heater assembly 24 includes a water heater 12 having at least one control panel 28 and a removable cover 30 positioned over the control panel 28 for selective access to the control panel 28. The water heater assembly 24 further includes an insulating cover 14 surrounding the water heater 12. The insulating cover 14 includes a substantially rectangular body 18 with opposed edges 20A, 20B overlapping or abutting one another and at least one flap 32 positioned to cover the removable cover 30 and configured to provide selective access to the removable cover 30, thereby facilitating removal of the removable cover 30 and access to the control panel 28. The insulating cover 14 further has a surface 34 on which indicia 36 can be printed. A fastener 22A affixes the overlapping or abutting edges 20A, 20B of the insulating cover 14, thereby securing the insulating cover 14 adjacent the water heater 12.

In yet another exemplary embodiment, an insulating cover 14 configured to be wrapped about an exterior surface 16 of a water heater 12 is provided. The insulating cover 14 includes a substantially rectangular body 18 and opposed edges 20A, 20B configured to overlap or abut one another when the insulating cover 14 is wrapped about the exterior surface 16 of the water heater 12. The insulating cover 14 further includes at least one downwardly facing flap 32 configured to provide selective access to the water heater 12, and a surface 34 on which indicia 36 can be printed.

In still another exemplary embodiment, a water heater kit 10 is provided. The water heater kit 10 includes a water heater 12 having at least one control panel 28 and a removable cover 30 positioned over the control panel 28 for selective access to the control panel 28. An insulating cover 14 is packaged with the water heater 12 and configured to surround the water heater 12. The insulating cover 14 includes a substantially rectangular body 18 with opposed edges 20A, 20B configured to overlap or abut one another and at least one downwardly facing flap 32 configured to cover the removable cover 30 and to provide selective access to the removable cover 30, thereby facilitating removal of the removable cover 30 and access to the control panel 28. The insulating cover 14 is rolled and packaged within a sleeve 50 prior to being wrapped about the water heater 12, thereby facilitating packaging of the insulating cover 14. A fastener 22 is packaged with the water heater 12 and configured to affix the edges 20A, 20B of the insulating cover 14 to secure the insulating cover 14 adjacent the water heater 12.

In another exemplary embodiment, a method of providing a water heater 12 having at least one control panel 28 and a removable cover 30 positioned over the control panel 28 for selective access to the control panel 28 is provided. An insulating cover 14 is packaged with the water heater 12, the insulating cover 14 having a substantially rectangular body 18 and at least one flap 32 configured to cover the removable cover 30 of the water heater 12 and to provide selective access to the removable cover 30. The insulating cover 14 is rolled to facilitate packaging of the insulating cover 14. A fastener 22 is packaged with the water heater 12, the fastener 22 being configured to affix edges 20A, 20B of the insulating cover 14 to secure the insulating cover 14 adjacent the water heater 12.

Referring now to FIG. 1, a water heater assembly embodying exemplary aspects of this invention is generally designated by the numeral "24." FIGS. 1-3 and 6-8 depict a commercial or residential water heater. However, the descriptions herein apply to commercial or industrial water heaters and residential or domestic water heaters, as well as other heat transfer systems.

The water heater assembly 24, as illustrated, includes a water heater 12 having a tank jacket 26, control panels 28 (shown in FIG. 3) mounted adjacent the tank jacket 26, and a removable cover 30 (also shown in FIG. 3) positioned over each control panel 28 for selective access to the respective control panel 28. Though not shown, a water heater storage tank is within tank jacket 26. The water heater 12 may further include, among other things, an inlet 38, an outlet 40, a drain valve 42, and a temperature and pressure (T&P) relief valve 44.

Figure 3:
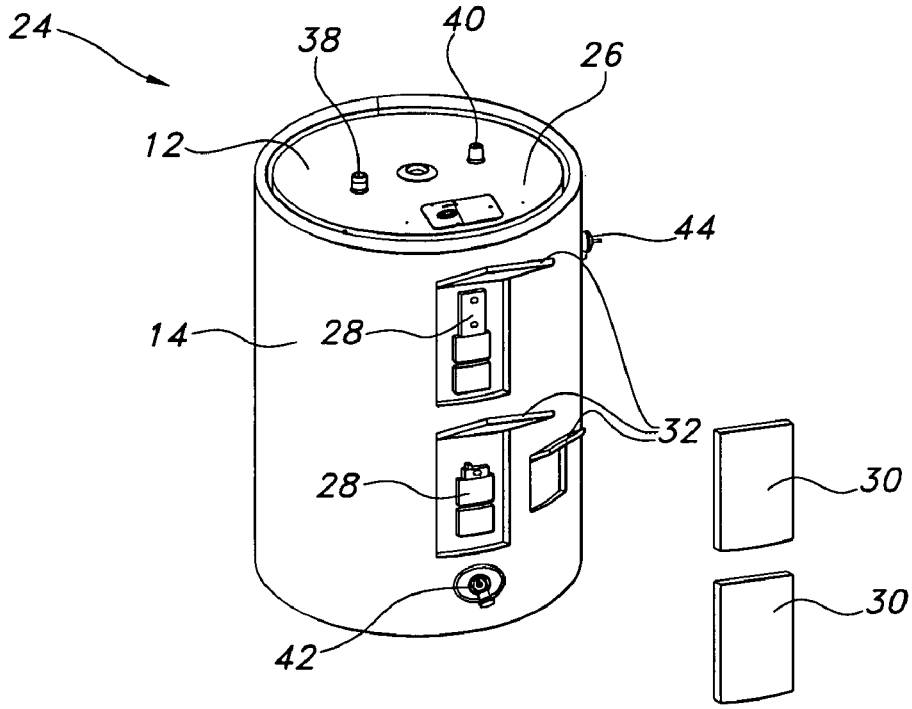
FIG. 3 is a front perspective view of the water heater assembly shown in FIG. 1, showing the downwardly facing flaps lifted to provide selective access to the water heater.

The insulating cover 14 is wrapped about the exterior surface 16 (shown in FIG. 8) of the water heater 12. The insulating cover 14 includes downwardly facing flaps 32 positioned over the removable covers 30 (shown in FIG. 3) and configured to provide selective access to the removable covers 30. More specifically, the downwardly facing flaps 32 may be lifted, as illustrated in FIG. 3, to facilitate removal of the removable covers 30 and access to the control panels 28. The insulating cover 14 also defines apertures 46 (shown in FIGS. 4 and 5) positioned over the drain valve 42 and T&P valve 44 to provide clear passage for the valves 42, 44.

Figure 9:
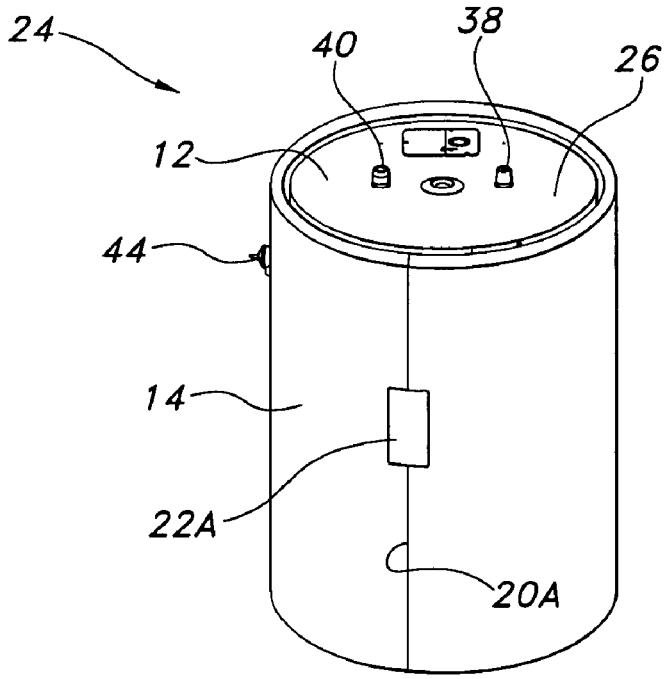
FIG. 9 is a back perspective view of the water heater assembly illustrated in FIG. 2, showing the insulating cover affixed to the water heater with an exposed vertical seam.

The insulating cover 14 includes a substantially rectangular body 18 with opposed edges 20A, 20B (shown in FIGS. 4 and 5) configured to overlap one another when the insulating cover 14 is wrapped about the exterior surface 16 of the water heater 12 (as shown in FIG. 9).

Figure 2:
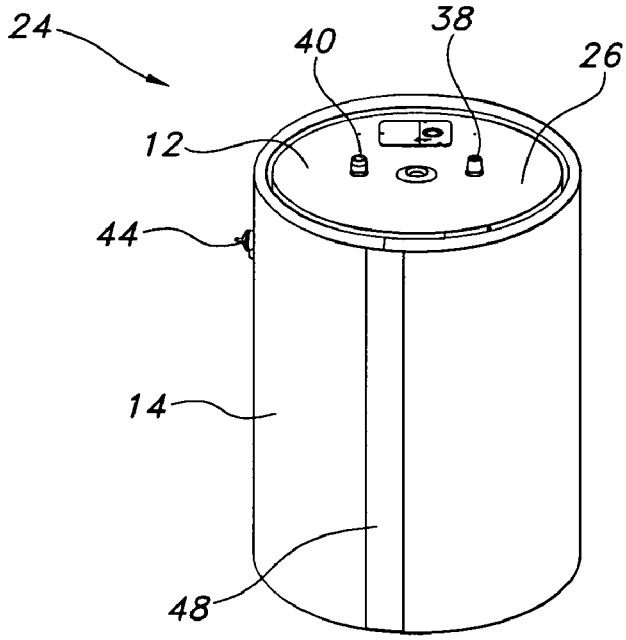
FIG. 2 is a back perspective view of the water heater assembly illustrated in FIG. 1 showing an embodiment of a seam cover covering a vertical seam created by opposed edges of the insulating cover.

FIG. 2 illustrates a seam cover 48 covering a vertical seam created by one of the opposed edges overlapping or abutting the other of the opposed edges.

FIG. 3 illustrates the downwardly facing flaps 32 lifted to provide selective access to the water heater 12. As explained above, the downwardly facing flaps 32 of the insulating cover 14 are positioned over the removable covers 30 and configured to provide selective access to the removable cover 30. FIG. 3 shows the downwardly facing flaps 32 lifted to facilitate removal of the removable covers 30 and access to the control panels 28.

Figure 4:
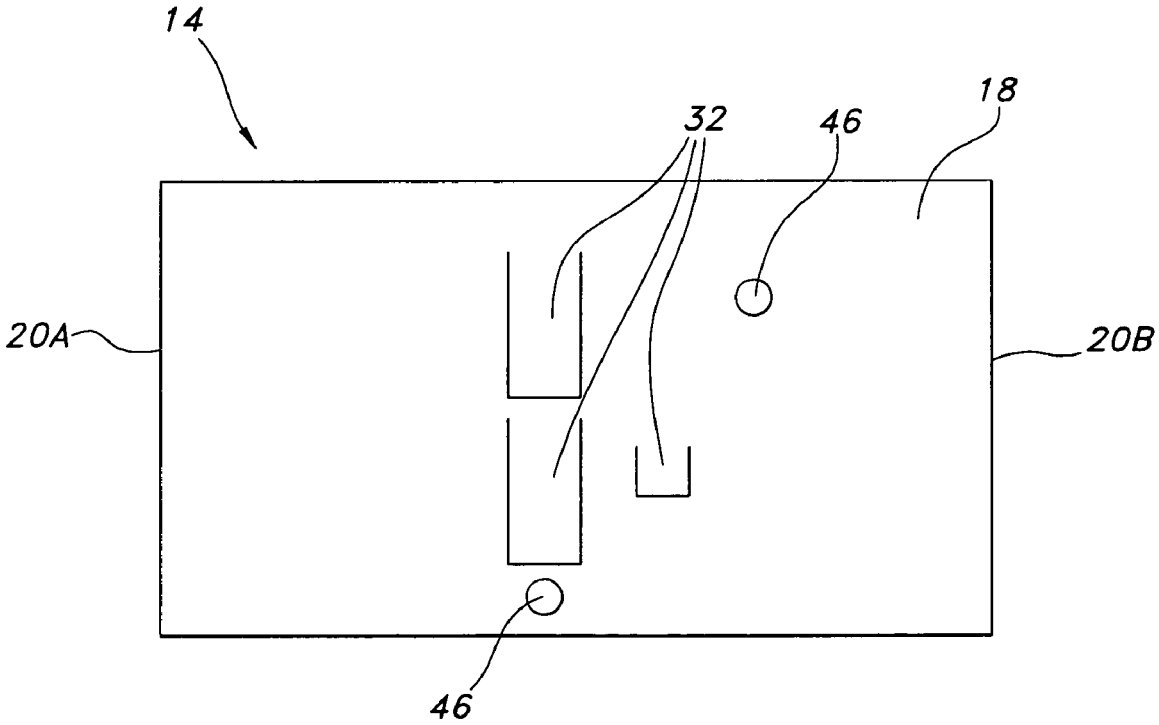
FIG. 4 is a front view of the insulating cover illustrated in FIG. 1, showing the insulating cover flattened.

FIG. 4 shows the insulating cover 14 flattened. As explained above, the insulating cover 14 includes a substantially rectangular body 18 with opposed edges 20A, 20B configured to overlap or abut one another when the insulating cover 14 is wrapped about the exterior surface 16 of the water heater 12 (as shown in FIG. 9). The quantity, size, shape, and location of the downwardly facing flaps 32 and the apertures 46 of the insulation cover 14 may vary, depending upon the configuration of the water heater 12, i.e., the quantity, size, shape, and location of the control panels and valves of a particular water heater. For example, the shape of the flaps 32 is not limited to rectangular as illustrated in FIGS. 1, 3-5, and 6. The shape of the flaps 32 may be circular, triangular, or any other shape suitable for providing adequate access to the control panels of a particular water heater.

The insulating cover 14 is preferably made from conventional insulation material, e.g., fiberglass. The insulating cover 14 is optionally covered with a facing material on one or both sides. According to one embodiment, the facing material is plastic or some other thermally insulating material such as vinyl. The insulating cover 14 of the present invention is not limited to fiberglass, however, and may include any other suitable material with the desired insulation properties.

Figure 5:
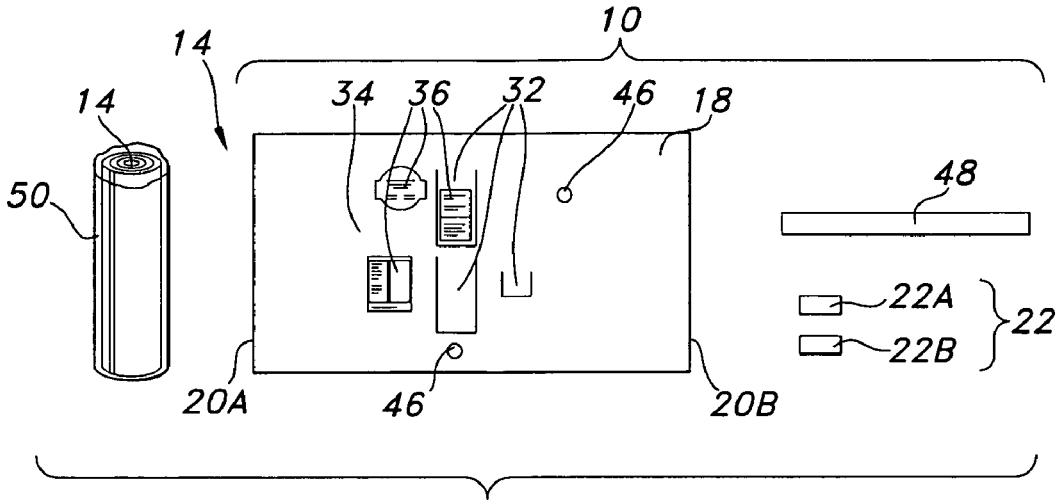
FIG. 5 is a view of an exemplary embodiment of an insulation kit configured for use with a water heater, including an insulating cover and fasteners.

FIG. 5 shows an insulation kit 10 for use with a water heater 12 as illustrated in FIGS. 1-4 and 6-8. The kit 10 includes the insulating cover 14 configured to be wrapped about an exterior surface 16 of the water heater 12. As explained above, the insulating cover 14 includes a substantially rectangular body 18 with opposed edges 20A, 20B configured to overlap one another when the insulating cover 14 is wrapped about the exterior surface 16 of the water heater 12.

Figure 8:
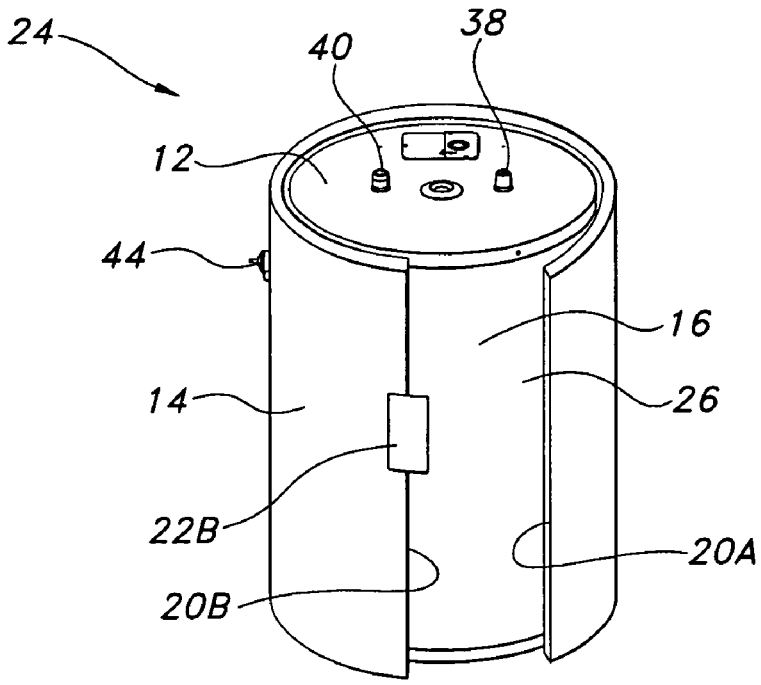
FIG. 8 is a back perspective view of the water heater assembly illustrated in FIG. 7, showing partial affixation of the insulating cover to the water heater.

The kit 10 further includes a fastener 22B configured for fixing one of the opposed edges 20B of the insulating cover 14 to the exterior surface 16 of the water heater 12, as shown in FIG. 8.

Another fastener 22A is configured for fixing the opposed edges 20A, 20B with respect to one another (as shown in FIG. 9), thereby securing the insulating cover 14 adjacent the exterior surface 16 of the water heater 12. The seam cover 48 covers the vertical seam created by one of the opposed edges 20A overlapping the other of the opposed edges 20B, as described above with reference to FIG. 2.

The insulating cover 14 further has a surface 34 on which indicia 36 can be printed. Such indicia may include, for example, product information, warning labels, etc. Indicia may be printed directly on the surface 34 of the insulating cover 14. Alternatively, indicia may be applied to the surface 34 of the insulating cover 14 in the form of one or more stickers or decals.

The fasteners 22A, 22B are preferably made from conventional adhesive tape, e.g., duct tape. The fasteners 22A, 22B of the present invention are not limited to tape, however, and may include any other fastening material or device suitable for securing the insulating cover 14 to the exterior surface 16 of the water heater 12. Similarly, the seam cover 48 is preferably made from conventional adhesive tape, e.g., duct tape. The seam cover 48 of the present invention is not limited to tape, however, and may include any other material suitable for covering the seam created by one of the opposed edges 20A overlapping or abutting the other of the opposed edges 20B.

Figure 6:
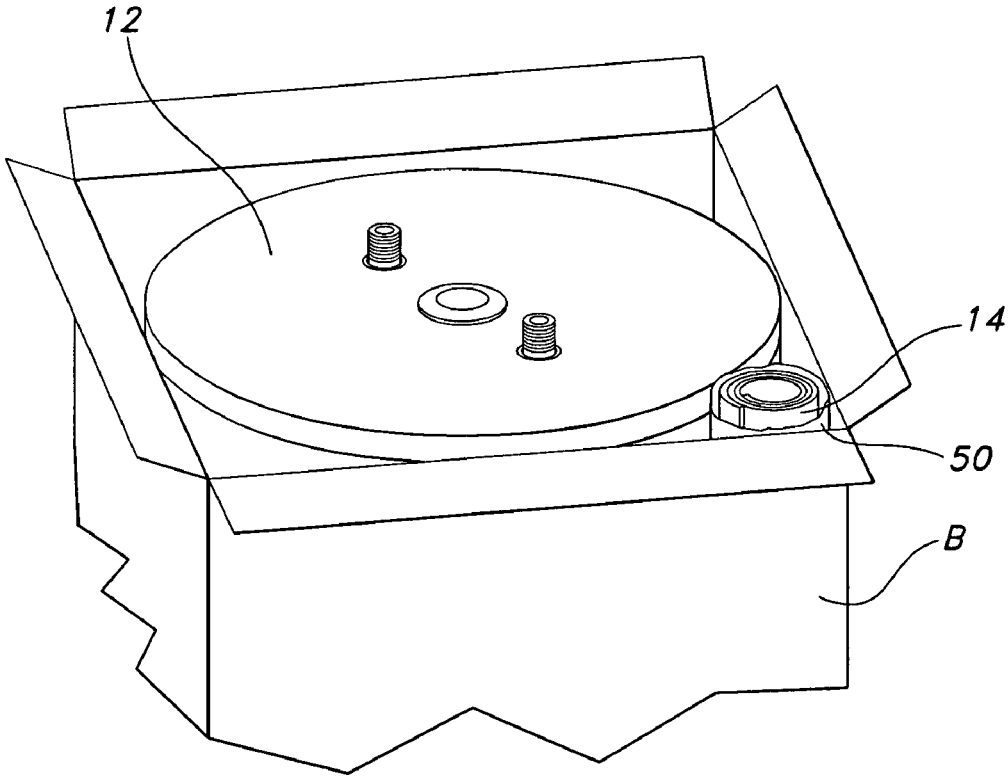
FIG. 6 is a top perspective schematic view of the water heater assembly shown in FIG. 1 and the insulation kit shown in FIG. 5, placed together within a packaging box.

The insulating cover 14 is rolled and packed within a sleeve 50 prior to being wrapped about the water heater 12 to facilitate handling or packaging of the insulating cover 14. The rolled insulation cover 14 packed within the sleeve 50 is typically placed in a corner of the packaging box for the water heater assembly 24 prior to shipping the assembly 24. For example, as illustrated in FIG. 6, if a box B having a substantially square cross-sectional shape is used to package a water heater 12 having a substantially round cross-sectional shape, the corner of the box B will be left empty. An insulation cover 14 (perhaps in a rolled configuration) can therefore be accommodated in the corner of the box B, thereby packaging the cover 14 with the water heater 12 and utilizing the interior of the box B.

The insulating kit 10 is typically installed on the water heater 12 after the water heater 12 is installed at its desired application. Specifically, the cover can be unrolled by the individual installing or using the water heater (if the cover is provided in a rolled configuration), and the individual or user can then apply or attach the cover to the water heater. Alternatively, the insulating kit 10 may be installed on the water heater 12 prior to shipping the assembly 24.

Figure 7:
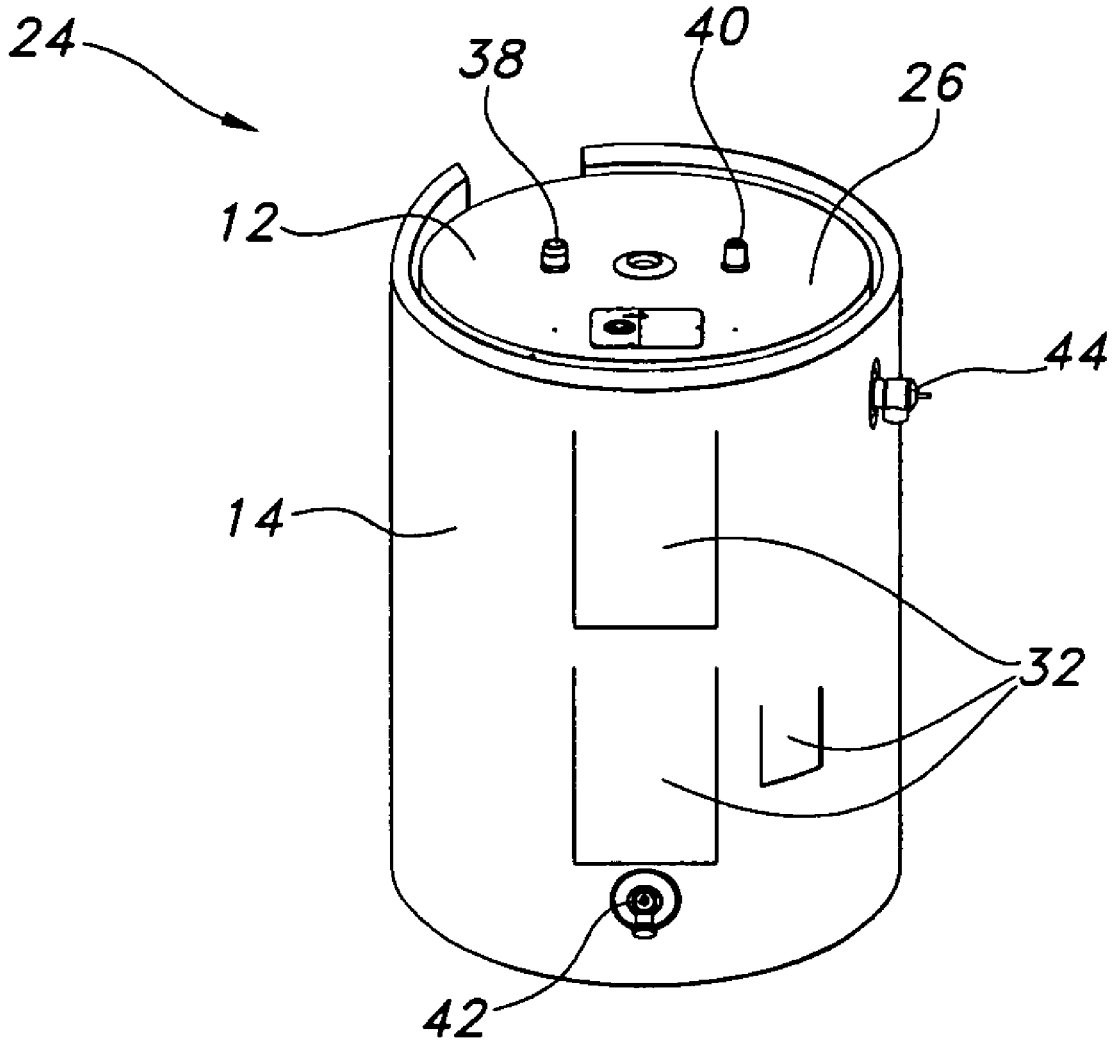
FIG. 7 is a front perspective view of the water heater assembly shown in FIG. 1, showing the insulating cover partially affixed to the water heater.

FIG. 7 shows the insulating cover 14 surrounding the tank of the water heater and partially affixed to the tank jacket 26 during the process of applying the cover to the water heater. FIG. 8 shows, more specifically, fastener 22B affixing opposed edge 20B of the insulating cover 14 to the exterior surface 16 of the tank or jacket or other external surface of the water heater 12.

FIG. 9 shows opposed edge 20A of the insulating cover 14 overlapping opposed edge 20B, and affixed to the insulating cover 14 via fastener 20A. The exposed vertical seam created by the overlapping opposed edges 20A, 20B is covered by a seam cover 48, as illustrated in FIG. 2.

In use, the insulating cover 14 is removed from the sleeve 50 and unrolled. With the vinyl film facing outward and the fiberglass material against the exterior surface 16 of the tank jacket 26, the insulating cover 14 is loosely wrapped around the water heater 12. The pre-cut openings (i.e., the downwardly facing flaps 32 and the apertures 46) of the insulation cover 14 are aligned with the control panels 28, the drain valve 42, and the T&P valve 44 of the water heater 12.

When the components of the water heater 12 are aligned with the pre-cut openings, opposed edge 22B of the insulating cover 14 is secured to the exterior surface 16 of the tank jacket 26 with fastener 20B, as illustrated in FIG. 8. Opposed edge 22A is wrapped around the water heater 12 until it overlaps opposed edge 22B, creating a vertical seam. Opposed edge 22A is secured to the insulating cover 14 with fastener 20A, as illustrated in FIG. 9.

The seam cover 48 is used to cover the vertical seam created by the overlapping opposed edges 20A, 20B, as illustrated in FIG. 2. The seam cover 48 improves the integrity of the connection of the cover to the water heater and also closes the seam to reduce heat loss between the edges of the cover.

The present invention improves the energy efficiency of the water heater 12, while providing for installation flexibility. More specifically, the insulating cover 14 may be installed on a water heater 12 in cramped locations with very little clearance space. Furthermore, the pre-cut openings (i.e., the downwardly facing flaps 32 and the apertures 46) of the insulation cover 14 allow easy access to serviceable components, safety information, and product ratings without having to remove the insulating cover 14, and also allows for clear passage of the valves 42, 44.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A water heater assembly comprising:

a water heater having a storage tank, a tank jacket positioned at least partially over the storage tank, at least one control panel mounted adjacent the tank jacket and a removable cover positioned over said control panel for selective access to said control panel;

an insulating cover surrounding said water heater, said insulating cover comprising a substantially rectangular body with opposed edges overlapping or abutting one another and at least one flap integrally formed in a surface of the insulating cover, positioned external of the tank jacket of the water heater and configured to cover said removable cover and provide selective access to said removable cover, thereby facilitating removal of said removable cover and access to said control panel, said insulating cover further having a surface on which indicia is printed; and a fastener affixing said overlapping or abutting edges of said insulating cover, thereby securing said insulating cover adjacent said water heater.

2. The water heater assembly of claim 1, wherein said water heater further comprises at least one valve and said insulating cover defines at least one aperture positioned over said valve and configured to provide clear passage for said valve.

3. The water heater assembly of claim 1, said flap of said insulating cover being downwardly facing.

4. The water heater assembly of claim 1, further comprising another fastener fixing one of said opposed edges of said insulating cover to the exterior surface of the water heater.

5. The water heater assembly of claim 1, further comprising a seam cover covering a seam created by one of said opposed edges overlapping or abutting the other of said opposed edges.

6. A water heater kit comprising:

a packaging container having at least one interior corner;

a water heater having at least one control panel and a removable cover positioned over said control panel for selective access to said control panel, said water heater being packaged inside said packaging container, a space being defined between an outer surface of the water heater and the at least one interior corner of the packaging container;

an insulating cover configured to surround said water heater, said insulating cover comprising a substantially rectangular body with opposed edges configured to overlap or abut one another and at least one downwardly facing flap integrally formed in a surface of the insulating cover and configured to cover said removable cover and to provide selective access to said removable cover, thereby facilitating removal of said removable cover and access to said control panel;

a sleeve, wherein said insulating cover is rolled and packaged within the sleeve prior to being wrapped about said water heater, the sleeve packaging the insulating cover being positioned in the space defined between the outer surface of the water heater and the at least one interior corner of the packaging container to facilitate packaging of the insulating cover; and a fastener packaged with said water heater in said packaging container and configured to affix said edges of said insulating cover to secure said insulating cover adjacent said water heater.

7. The water heater kit of claim 6, further comprising another fastener configured for fixing one of said opposed edges of said insulating cover to the exterior surface of said water heater.

8. The water heater kit of claim 6, further comprising a seam cover configured to cover a seam created by one of said opposed edges overlapping or abutting the other of said opposed edges.

9. The water heater kit of claim 6, wherein said insulating cover further comprises a surface on which indicia is printed.

10. A method of providing a water heater having at least one control panel and a removable cover positioned over the control panel for selective access to the control panel, said method comprising the steps of:

packaging the water heater in a packaging container;

packaging within a sleeve an insulating cover having a substantially rectangular body and at least one flap integrally formed in a surface of the insulating cover and configured to cover the removable cover of the water heater and to provide selective access to the removable cover;

positioning the sleeve containing the insulating cover in a space defined between an outer surface of the water heater and an interior corner of the packaging container to facilitate packaging of the insulating cover; and packaging in the packaging container fastener configured to affix edges of the insulating cover to secure the insulating cover adjacent the water heater.

11. The method of claim 10, wherein indicia is applied to a surface of the insulating cover that is rolled and placed within the sleeve.

* * * * *